US007124960B2

(12) United States Patent
Schach et al.

(10) Patent No.: US 7,124,960 B2
(45) Date of Patent: Oct. 24, 2006

(54) ELECTRIC ARC WIRE BURNER

(75) Inventors: Sven Schach, Eesingen (DE); Tilmann Haug, Weissenhorn (DE); Alexander Sagel, Plochingen (DE)

(73) Assignee: DaimlerChrysler AG, Ulm (DE)

( * ) Notice: Subject to any disclaimer, the term of this patent is extended or adjusted under 35 U.S.C. 154(b) by 0 days.

(21) Appl. No.: 10/528,540

(22) PCT Filed: Sep. 17, 2003

(86) PCT No.: PCT/DE03/03088

§ 371 (c)(1),
(2), (4) Date: Sep. 26, 2005

(87) PCT Pub. No.: WO2004/028702

PCT Pub. Date: Apr. 8, 2004

(65) Prior Publication Data

US 2006/0124762 A1 Jun. 15, 2006

(30) Foreign Application Priority Data

Sep. 20, 2002 (DE) ..... 102 43 739

(51) Int. Cl.
*B05B 1/24* (2006.01)

(52) U.S. Cl. ..... 239/84; 239/83; 239/85; 239/79; 219/76.16; 219/121.48; 219/121.5; 427/446; 427/449

(58) Field of Classification Search ..... 239/79–85; 219/76.14, 76.15, 121.47, 121.48, 121.5; 427/446, 449

See application file for complete search history.

(56) References Cited

U.S. PATENT DOCUMENTS

| | | | | |
|---|---|---|---|---|
| 3,141,616 | A * | 7/1964 | Cauchetier | 239/81 |
| 4,853,513 | A * | 8/1989 | Fuimefreddo | 219/76.14 |
| 4,937,417 | A * | 6/1990 | Fox | 219/76.1 |
| 6,076,742 | A * | 6/2000 | Benary | 239/84 |

* cited by examiner

*Primary Examiner*—Dinh Q. Nguyen
(74) *Attorney, Agent, or Firm*—Akerman Senterfitt; Stephan A. Pendorf; Yonghong Chen

(57) ABSTRACT

The invention relates to an electric arc wire burner for spraying an electric arc, comprising at least two burner tubes (3) for feeding electrodes which are embodied in the form of wire (5). Said electrodes are guided through the burner tube (3) in the direction of the surface of the object which is to be coated. The wire (5) is guided by a deflection device (7) comprising a number of rotationally mounted guiding elements and/or sliding elements (8) and the wire (5) is deformed in an elastic area.

10 Claims, 4 Drawing Sheets

ELECTRIC ARC WIRE BURNER

CROSS REFERENCE TO RELATED APPLICATION

This application is a national stage of PCT/DE2003/003088 filed Sep. 17, 2003 and based upon DE 102 43 739.4 filed Sep. 20, 2002 under the International Convention.

BACKGROUND OF THE INVENTION

1. Field of the Invention

The invention relates to a plasma wire burner for plasma spray having at least two burner tubes for supplying electrodes which are in the form of wires and are passed through the burner tube in the direction of the surface of an object to be coated via a feed device which has numerous guiding and/or sliding elements which are mounted such that they can rotate.

2. Related Art of the Invention

Plasma wire burners having a variant large number of guiding means for the spray wire are already known in a general form. JP 01 198 461 A, JP 02 245 255 A, JP 02 307 555 A, JP 05 168 985 A and JP 07 090 537 A should be cited by way of example.

An inner burner for plasma wire spraying of cavities, in particular of cylindrical running surfaces, is already known (DE 198 41 617 A1). The inner burner has two burner tubes which are provided for feeding wire electrodes. The electrodes are melted by means of a plasma. Furthermore, the inner burner has a gas supply for a process gas, which is provided for transportation and atomization of the molten wire material in the direction of that surface of the cavity which is to be coated. The electrodes or the wires are fed towards one another through the burner tubes on the outlet side and in the area of the plasma, with the plasma from the electrode wires, which is arranged in the contact area of the wires, being arranged in the area of the gas flow of the emerging process gas. The gas flow of the emerging process gas, which is referred to for simplicity in the following text as the main gas flow direction, is arranged transversely with respect to the main transportation direction of the wires, which is governed by the burner tubes. Layers which are sprayed by means of an inner burner such as this onto, in particular, a metallic substrate, preferably a cylindrical running surface, are generally highly porous.

A welding burner with a feed apparatus for electrodes in the form of wire is known from JP-11 342471, which electrodes are passed through the burner tube via rollers which are mounted such that they can rotate, in the direction of that surface of an object which is to be coated, with the feed device being provided outside the welding burner.

SUMMARY OF THE INVENTION

The invention is based on the object of improving the wire feed in the plasma wire burner in such a way that the wire is guided precisely to the short-circuiting point on the plasma wire burner.

According to the invention, the object is achieved in that the feed device which has guiding and/or sliding elements and by means of which the wire is deformed in the elastic or plastic range is integrated in the burner tube or is held in it, and in that the sliding elements are in the form of rollers or rollers having ball bearings.

It is advantageous for the burner or the supply tube to be formed from three components which can be joined together, and for the feed device together with its sliding elements to be integrated in the burner in the area of at least one intersection plane of two parts which can be joined together.

It is also advantageous for the burner or the supply tube to have an approximately circular cross section when viewed from the front, and for the central section of the burner or of the supply tube to be approximately wedge-shaped when viewed from the front.

It is also advantageous for two feed apparatuses to be provided and for one feed apparatus in each case to be arranged in the area of in each case one intersection point of the burner and of the supply tube, with a cathode wire being guided via the first feed apparatus, and an anode wire being guided via the other feed apparatus. Channels which are not illustrated in the drawing are provided for this purpose in the burner tube, via which it is also possible to pass the inert gas, by means of which the wires and the rollers can also be cooled.

This results in the advantageous design and arrangement of the deflection device in conjunction with the sliding elements ensuring that the wire is guided exactly within the plasma wire burner as far as the short-circuiting point of the burner, for which purpose the wire can also be deformed in the elastic range without any significant increase occurring in the friction forces, and thus without any significant increase in wear. The wire is guided precisely by the change in direction in the contact-making wire guides.

For this purpose, it is advantageous for the deflection device to have numerous deflection rollers which are arranged one behind the other at a distance from one another and interact with at least one deflection roller whose diameter is the same or larger, which, together with the numerous deflection rollers for holding the wire, form a guide path.

According to one development, an additional option is for the larger deflection roller to be arranged with its external circumference at a distance from the numerous opposite deflection rollers which are arranged one behind the other, with the distance between the larger deflection roller and the numerous deflection rollers which are arranged one behind the other and interact with it being approximately of the same size as or larger than the diameter of the wire.

It is also advantageous for each deflection roller to be arranged at the same distance from the external circumference of the opposite large deflection roller.

For this purpose, it is also advantageous for the wire to be guided via a deflection device which has numerous guiding and/or sliding elements which are mounted such that they can rotate, by means of which deflection device the wire is deformed in the elastic or plastic range, with the deflection device having numerous deflection rollers which are arranged one behind the other and are mounted in ball bearings, and having at least one deflection roller which has a larger diameter, is likewise mounted in a ball bearing and is arranged with its external circumference at a distance from the numerous deflection rollers which are arranged one behind the other, with the distance being approximately the same as or larger than the diameter of the wire. Since the individual sliding elements, which are arranged one behind the other, or the deflection rollers, which are arranged on axes by means of ball bearings, are positioned between two parallel-running discs this results in very exact, low-wear wire feeding in a very small space and in optimum feed control of the wire as far as the short-circuiting point of the plasma wire burner.

For this purpose, the individual ball bearings may be in the form of miniature ball bearings, so that it is possible to considerably reduce the overall volume of the entire apparatus. Furthermore, the use of the rollers which are held in ball bearings considerably reduces the maintenance intervals for the plasma wire burner. A further advantage of the use of the deflection rollers is also that the feed-proof force can be reduced and the wear can be kept very low.

Finally, one preferred embodiment of the solution according to the invention provides for the deflection rollers to have a guide groove, which is arranged concentrically with respect to the axis, for guiding the wire.

It is of particular importance for the present invention that the shafts of the deflection rollers are held in two plates which are arranged at a distance from one another, and between which the deflection rollers are arranged such that they can rotate.

It is also advantageous for a sliding contact to be provided in front of and behind the deflection rollers and to be pressed against the surface of the wire by means of a spring.

The use of a sliding contact in front and behind the ball bearing deflection optimally maintains the power supply to the wire.

It is also advantageous for numerous deflection rollers which are arranged one behind the other to be provided in a first row and in a second row at a distance from it, in order to guide the wire.

Furthermore, it is advantageous for at least three sliding elements to be provided, two of which are arranged one behind the other.

It is also particularly advantageous for a total of only three deflection rollers or sliding elements to be provided. In this case, it is advantageous for two sliding elements to be provided on one side of the electrode and for a further deflection element to be provided on the other side of the electrode, to be precise between the two deflection rollers, so that this results in a three-point contact for the electrode.

BRIEF DESCRIPTION OF THE DRAWINGS

Further advantages and details of the invention are explained in the patent claims and in the description, and are illustrated in the figures, in which:

DETAILED DESCRIPTION OF THE INVENTION

Figure 1:
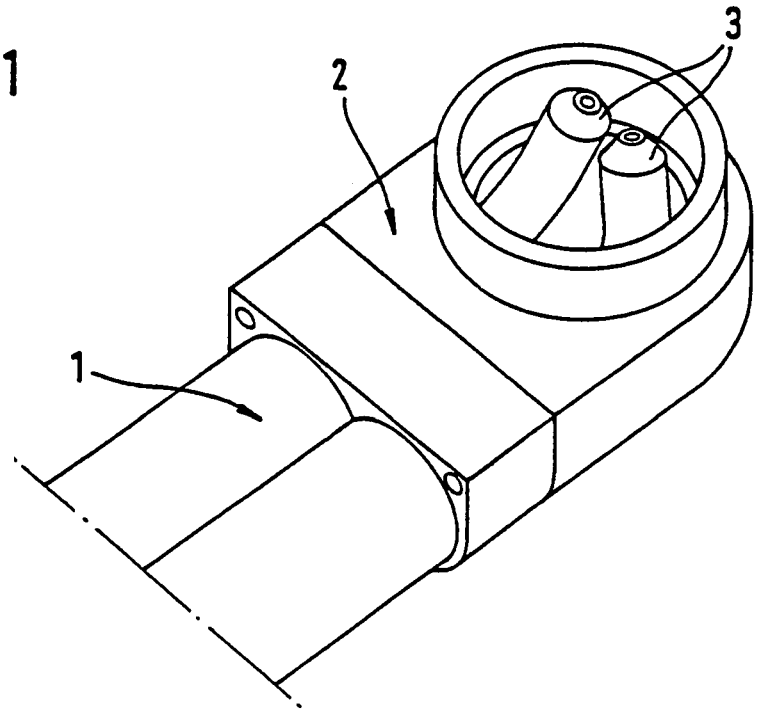
FIG. 1 shows a perspective view of the plasma wire burner.

In the drawing, 1 denotes a supply tube for a plasma wire burner which can be used in particular for plasma wire spraying of cavities, for example of cylindrical running surfaces. The inner burner for this purpose has a nozzle head 2 which is connected to burner tubes 3. Two burner tubes 3 for feeding electrodes 5, which are in the form of wires, are located at the outlet opening of the nozzle head 2. The electrodes or the wires 5 are intended to be melted in a plasma. The droplets which are formed from the molten wires 5 are transported and atomized by a process gas in the direction of that surface of the cavity which is to be coated.

In order that the plasma can be formed between the ends of the wires 5, the two wires 5 are fed towards one another on the outlet side after the burner tubes. The wires are fed by means of a feed device or deflection device 7, which is illustrated schematically in the two exemplary embodiments shown in FIGS. 2 and 4.

The feed or deflection device 7 comprises two plates 12 and 13 which are arranged at a distance 4 from one another, run parallel, and can be held together via connecting elements which are not illustrated in the drawing.

The plates 12 and 13 of the deflection device 7 have numerous guiding or sliding elements 8 which are arranged one behind the other and are held by means of shafts 10 in the plates 12 and 13 such that they can rotate. The individual deflection rollers 8 are mounted on the shafts 10 such that they can rotate freely by means of ball bearings which are not illustrated in the drawing.

Figure 2:
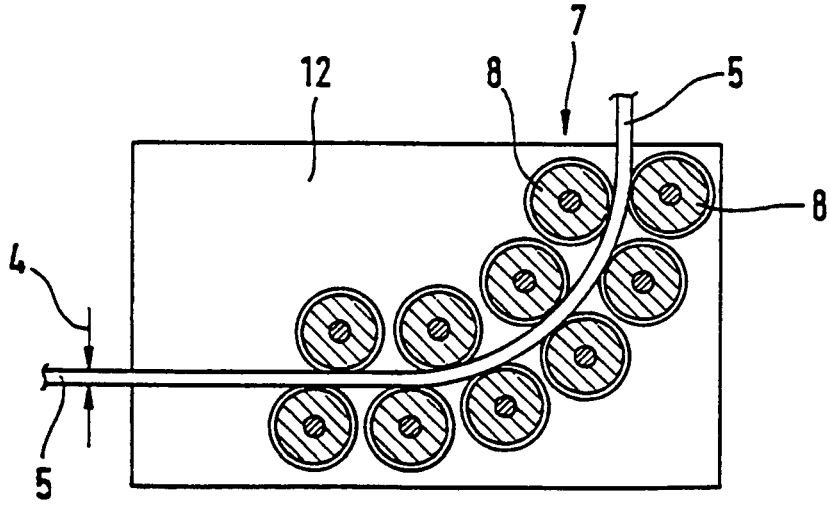
FIG. 2 shows a first exemplary embodiment of a deflection device having deflection rollers arranged in two rows.
Figure 3:
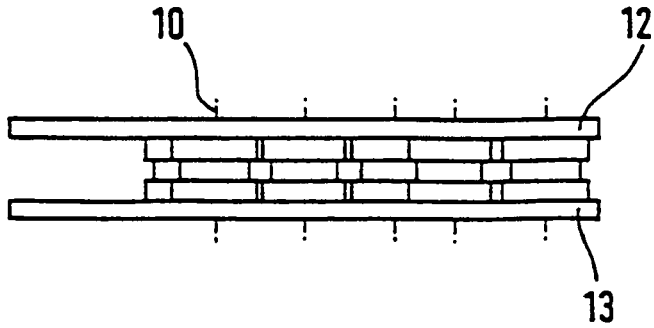
FIG. 3 shows a view corresponding to that in FIG. 1, from above.

As can be seen in FIG. 2, the upper row of guide rollers 8 run on a circular arc. The individual guide rollers 8 are arranged a short distance away from the numerous adjacent guide rollers 8, which are located alongside one another. For this purpose, a second row of guide rollers 8 is located underneath the upper row of guide rollers 8, and these are likewise arranged a short distance apart from one another. The axes 10 and the external circumference of two opposite deflection rollers 8 are separated by the distance 4 which corresponds approximately to the external diameter of the wire 5. The distance 4 between the external circumference of the opposite guide rollers 8 is preferably the same as or slightly larger than the external diameter of the wire 5. The numerous guide rollers 8 which are arranged in two rows one behind the other each lie on a curved path and, by virtue of the distance 4 between them, form a guide path through which the wire 5 is moved by means of the guide rollers 8.

Figure 4:
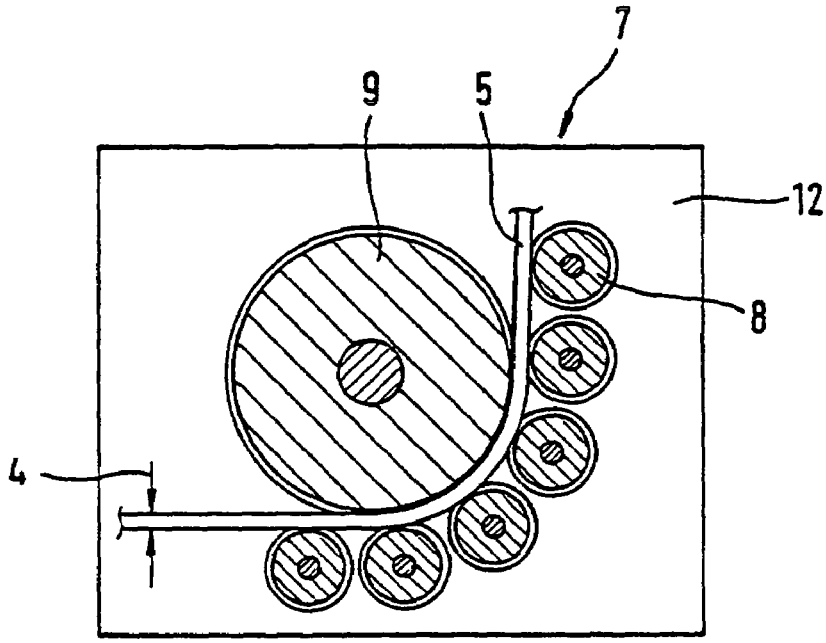
FIG. 4 shows a second exemplary embodiment of the deflection device having one large deflection roller and numerous smaller deflection rollers which are arranged one behind the other.

As can be seen from FIG. 2 and FIG. 4, the wire 5 may in this case be deformed in the elastic range or else in the plastic range. The deflection of the wire 5 by means of the contact-making deflection rollers 8 which, as already mentioned, are advantageously arranged on ball bearings that are not illustrated in the drawing, keeps the friction forces small, owing to the plastic or elastic deformation of the wire 5. Since two or more different deflection rollers 8 and 9, which are arranged on ball bearings, are provided one behind the other, the wire 5 is guided precisely as far as the short-circuiting point of the plasma wire burner. The use of miniature ball bearings makes it possible to keep the overall volume required for the entire apparatus small, or to considerably reduce it, and also to increase the life of the apparatus.

At the same time, the advantageous arrangement of the deflection rollers 8 and 9 and their design increase the maintenance intervals for the plasma wire burner.

Figure 5:
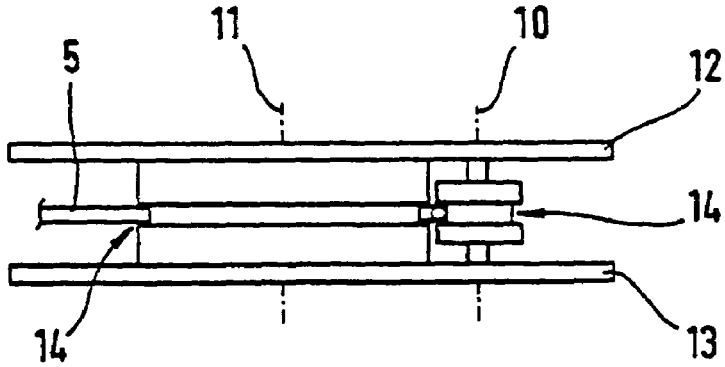
FIG. 5 shows a view of the deflection device as shown in FIG. 4, from above.

The individual deflection rollers 8 and 9 as shown in FIG. 5 may advantageously be equipped with a guide groove 14 which runs concentrically with respect to the axis 10 and via which the wire 5 is moved onwards.

As can be seen from FIG. 2, four deflection rollers 8 are located in the upper row and six deflection rollers 8 are located in the row beneath this, each lying on a circular arc.

Depending on the design conditions and the requirements, a greater or lesser number of deflection rollers 8 can also be provided one behind the other.

FIG. 4 shows a second exemplary embodiment of the feed device or deflection device 7. This likewise comprises two plates 12 and 13, which are arranged at a distance from one another, for holding the shafts 10 for the smaller deflection rollers 8, and a shaft 11 for a deflection roller 9 with a considerably larger diameter. In the exemplary embodiment shown in FIG. 4, the diameter of the deflection roller 9 is approximately four times as great as the diameter of the smaller deflection roller 8.

Figure 7:
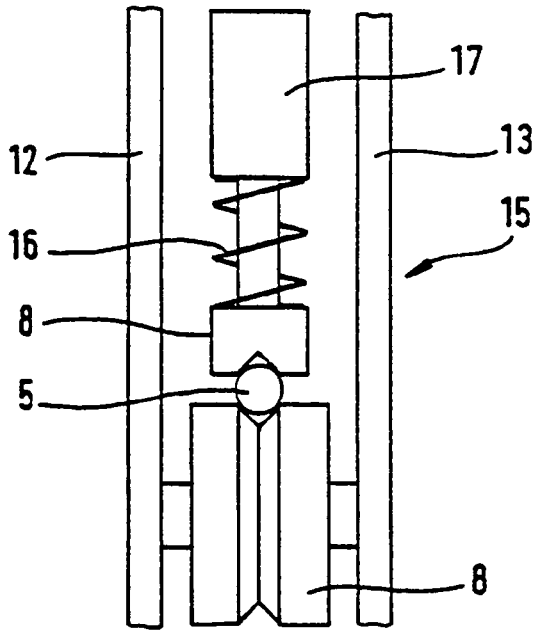
FIG. 7 shows a sliding contact for power transmission.

The individual deflection rollers 8 are arranged with their external circumference at the same distance 4 from the external circumference of the larger deflection rollers 9. The deflection device 7 can also be equipped with a sliding contact 15, as shown in FIG. 7. One or more sliding contacts 15 can be provided in front of and behind the ball bearing deflection.

The sliding contact 15 may also comprise a piston which is guided in a cylinder 17 and at whose end the deflection roller or the sliding element 8 is arranged, which is pressed against the surface of the wire 5 by means of the spring 16. The sliding contacts 15 ensure adequate power transmission and the electrical power supply to the wire 5.

Figure 6:
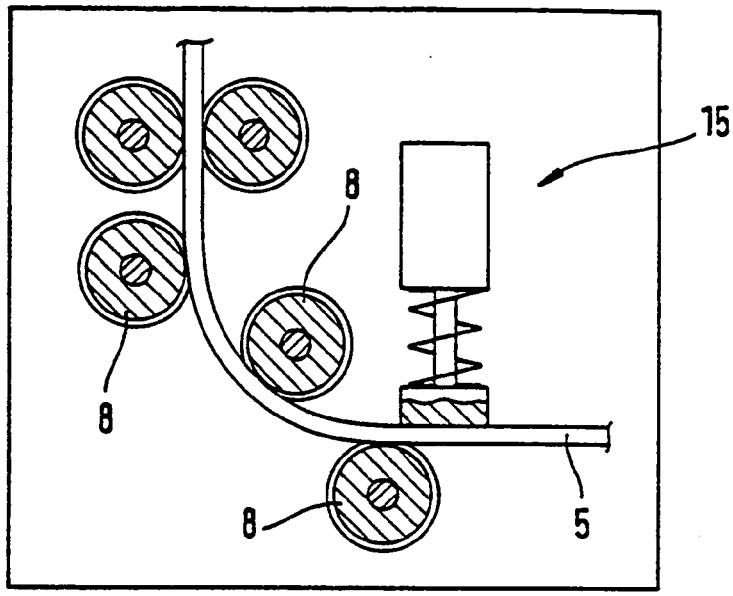
FIG. 6 shows a third exemplary embodiment, in which a total of five deflection rollers are used.

FIG. 6 shows a further exemplary embodiment of a deflection device 7, with two upper opposite sliding rollers or sliding pieces 8 and three sliding rollers 8, which are arranged with an offset with respect to one another underneath these, being provided in the exemplary embodiment shown in FIG. 6. The two lower deflection rollers or sliding elements 8 are advantageously arranged further apart. The third deflection roller is located opposite, between these two deflection rollers 8. For space and cost reasons, it is also possible to manage with a total of only three deflection rollers or sliding elements 8, thus providing a three-point contact for the wire or the electrode 5, which nevertheless ensures that the wire 5 is guided adequately well.

Figure 8:
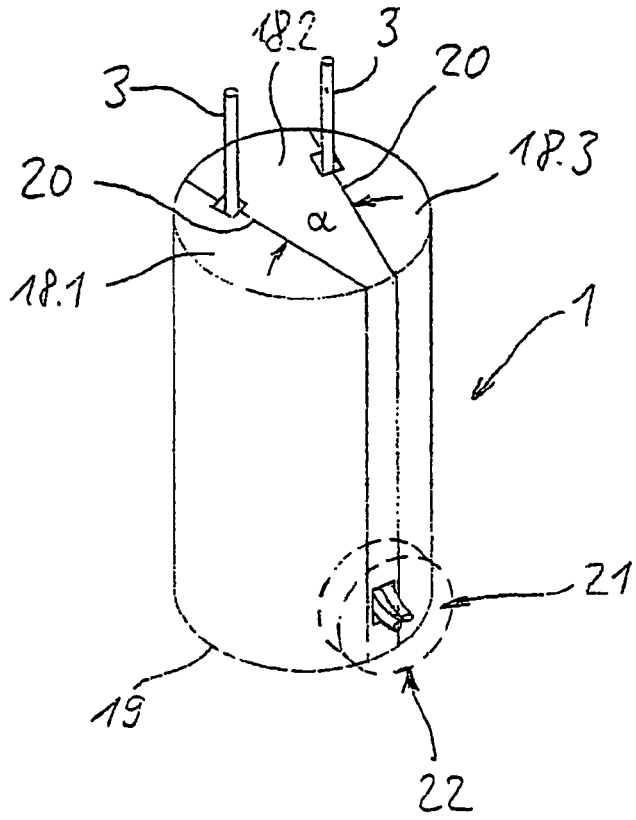
FIG. 8 shows a perspective schematic illustration of the front supply tube, which is formed from three segments.
Figure 9:
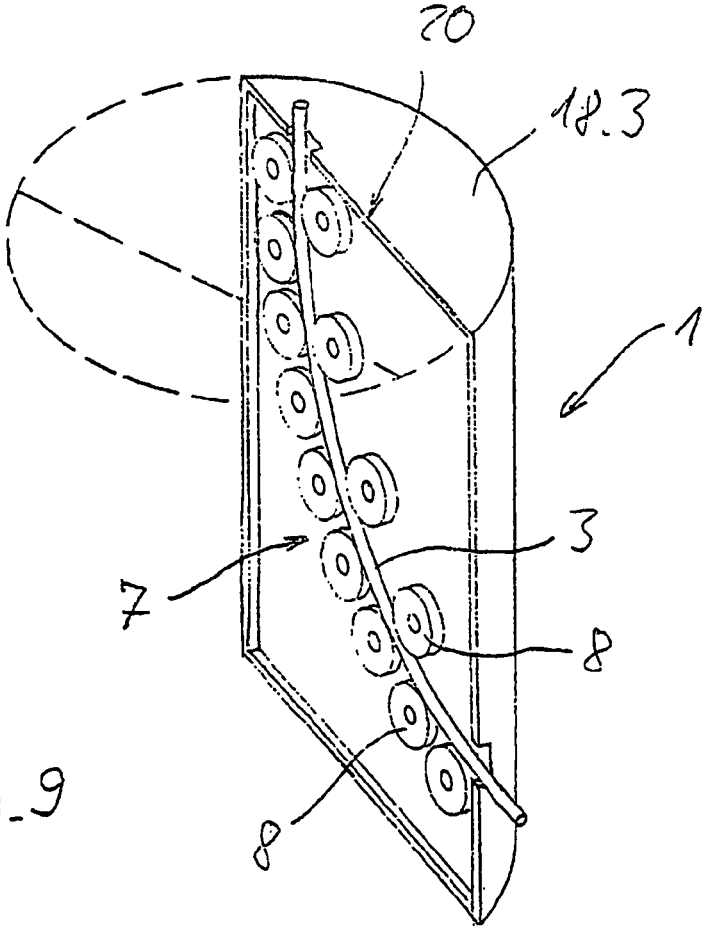
FIG. 9 shows the supply tube as shown in FIG. 8, with two segments having been omitted in order to illustrate it better.

According to a further example, which is illustrated in FIGS. 8 and 9, it is also possible for the burner or the supply tube 1 to be formed from three segments 18.1 to 18.3 or components which can be joined together, and for the feed device 7 together with its sliding elements and guide rollers 8 to be integrated in the burner 1 in the area of at least one intersection plane of two parts which can be joined together.

The burner or the supply tube 1 may have an approximately circular cross section when viewed from the front (FIG. 8), with the central segment 18.2 of the burner or of the supply tube 1 being approximately wedge-shaped when viewed from the front. The two surfaces of the wedge-shaped component may include an angle a of 10° to 40°, preferably of 15° to 30°, and best of all an angle of 17°. The three segments or components 18.1 to 18.3 which form the burner 3 are either connected via connecting elements which are not illustrated in the drawing, or are welded or adhesively bonded to one another.

The described burner 1 has two feed apparatuses 7 in the area of the intersection points 20 of the burner or of the supply tube 1, with a cathode wire being guided via the first feed apparatus 7, and an anode wire being guided via the other feed apparatus.

A nozzle attachment 22, which is used for atomization of the emerging gas, can be provided in the area of the outlet end of the burner tube 3. This is indicated schematically by a dashed line in the drawing shown in FIG. 8.

LIST OF REFERENCE SYMBOLS

1 Supply tube for a plasma wire burner or burner
2 Nozzle head
3 Burner tube
4 Distance
5 Wire, electrode
7 Feed device or deflection device
8 Guiding and/or sliding element, deflection roller or sliding element
9 Guiding and/or sliding element, larger deflection roller
10 Axis
11 Axis
12 Plate
13 Plate
14 Guide groove
15 Sliding contact
16 Spring
17 Cylinder
18.1 Segment
18.2 Segment
18.3 Segment
19 Circular cross section
20 Intersection point
21 Outlet end
22 Nozzle attachment

The invention claimed is:

1. A plasma wire burner for plasma spray, comprising:

at least two burner tubes (3) for supplying electrodes in the form of wires (5) from a supply tube (1), a feed device (7) for passing an electrode through a burner tube (3) in a direction toward a surface of an object to be coated, the feed device has a plurality of guiding and/or sliding elements (8) which are mounted such that they can rotate for deforming the wire in an elastic or plastic range, wherein the feed device (7) is integrated in the burner tube (3) or is held in it, and wherein the guiding and/or sliding elements (8) are in the form of rollers or ball bearing mounted rollers, wherein the burner or the supply tube (1) is formed from three segments which can be joined together, wherein the burner or the supply tube (1) has an approximately circular cross section when viewed from the front, and wherein the central segment of the burner or of the supply tube (1) is approximately wedge-shaped when viewed from the front.

2. The plasma wire burner as claimed in claim 1, wherein two feed devices (7) are provided and one feed device (7) is in each case arranged in one intersection point of the burner or the supply tube (1), with a cathode wire being guided via the first feed device, and an anode wire being guided via the other feed device.

3. The plasma wire burner as claimed in claim 1, wherein the feed device is a deflection device (7) having a plurality of deflection rollers (8) which are arranged one behind the other at a distance from one another and interact with at least one deflection roller (9) whose diameter is the same or larger, which, together with the plurality of deflection rollers for holding the wire (5), form a guide path.

4. The plasma wire burner as claimed in claim 3, wherein the larger deflection roller (9) is arranged with its external circumference at a distance (4) from the plurality of opposite deflection rollers (8), with the distance (4) between the larger deflection roller (9) and the plurality of deflection rollers (8) being approximately of the same size as or larger than the diameter of the wire (5).

5. The plasma wire burner as claimed in claim 3, wherein each deflection roller (8) is arranged at the same distance (4) from the external circumference of the opposite larger deflection roller (9).

6. The plasma wire burner as claimed in claim 3, wherein the wire is guided via the deflection device (7), the plurality of deflection rollers (8) are mounted in ball bearings, and the at least one deflection roller (9) which has a larger diameter, is likewise mounted in a ball bearing and is arranged with its external circumference at a distance (4) from the plurality of deflection rollers (8), with the distance (4) being approximately the same as or larger than the diameter of the wire (5).

7. The plasma wire burner as claimed in claim 3, wherein the deflection rollers (8, 9) have a guide groove (14) which is arranged concentrically with respect to axis (10, 11) of the deflection rollers, for guiding the wire (5).

8. The plasma wire burner as claimed in claim 1, wherein shafts (10, 11) of the deflection rollers (8, 9) are held in two segments or plates (12, 13) which are ranged at a distance from one another and between which the deflection rollers are arranged such that they can rotate.

9. The plasma wire burner as claimed in claim 3, wherein a sliding contact (15) is provided in front of and/or behind the deflection rollers (8, 9) and is pressed against the surface of the wire (5) by means of a spring (16).

10. The plasma wire burner as claimed in claim 3, wherein the plurality of deflection rollers (8) which are arranged one behind the other are provided in a first row and in a second row at a distance (4) from the first row, in order to guide the wire (5).

* * * * *